US005593821A

United States Patent [19]

Oyamada

[11] Patent Number: 5,593,821

[45] Date of Patent: Jan. 14, 1997

[54] SILVER HALIDE EMULSION AND PHOTOGRAPHIC MATERIAL HAVING THE SAME

[75] Inventor: Takayoshi Oyamada, Kanagawa-ken, Japan

[73] Assignee: Fuji Photo Film Co., Ltd., Kanagawa, Japan

[21] Appl. No.: 486,580

[22] Filed: Jun. 7, 1995

[30] Foreign Application Priority Data

Jun. 30, 1994 [JP] Japan ..... 6-149209

[51] Int. Cl.[6] ..... G03C 1/035; G03C 1/09

[52] U.S. Cl. ..... 430/567; 430/603

[58] Field of Search ..... 430/567, 603

[56] References Cited

U.S. PATENT DOCUMENTS

| | | | |
|---|---|---|---|
| 4,063,951 | 12/1977 | Bogg | 430/569 |
| 4,777,125 | 10/1988 | Delfino et al. | 430/567 |
| 5,114,838 | 5/1992 | Tamada | 430/569 |
| 5,238,807 | 8/1993 | Sasaki et al. | 430/603 |
| 5,292,632 | 3/1994 | Maskasky et al. | 430/567 |
| 5,314,798 | 5/1994 | Brust et al. | 430/567 |
| 5,320,937 | 6/1994 | Ihama | 430/603 |
| 5,320,938 | 6/1994 | House et al. | 430/567 |
| 5,342,750 | 8/1994 | Jasaki et al. | 430/603 |
| 5,356,764 | 10/1994 | Szajewski et al. | 430/505 |
| 5,422,232 | 6/1995 | Asami et al. | 430/603 |
| 5,429,916 | 7/1995 | Ohshima et al. | 430/603 |
| 5,449,596 | 9/1995 | Kawai et al. | 430/567 |
| 5,457,021 | 10/1995 | Olm et al. | 430/567 |

*Primary Examiner*—Janet C. Baxter

*Attorney, Agent, or Firm*—Sughrue, Mion, Zinn, Macpeak & Seas

[57] ABSTRACT

Disclosed are a silver halide emulsion which comprises multi-layered silver halide grains each having a major face of {100}, having a total Cl content of 20 mol %/mol of Ag or more and having an aspect ratio of 2 or more and which has been sensitized by selenium and/or tellurium sensitization, and a silver halide photographic material comprising the emulsion. The emulsion has a high sensitivity and a low fog, while having a high covering power. The intergranular uniformity of the halide composition in the multi-layered silver halide grains in the emulsion is good. Rapid processing of the photographic material is possible.

15 Claims, No Drawings

SILVER HALIDE EMULSION AND PHOTOGRAPHIC MATERIAL HAVING THE SAME

FIELD OF THE INVENTION

The present invention relates to a silver halide emulsion and a photographic material having the emulsion, which are rapidly processable while needing reduced amounts of replenishers to the processing solutions and which are highly color-sensitizable with color sensitizing dyes. The present invention also relates to a silver halide emulsion and a photographic material, which have high sensitivity and have high resistance to pressure fog.

BACKGROUND OF THE INVENTION

Multi-layered silver halide grains are known, such as those described in JP-A-60-143331, JP-A-62-196644, JP-A-61-112142, etc. (The term "JP-A" as used herein means an "unexamined published Japanese patent application".) In JP-A-62-123445, disclosed are multi-layered silver halide tabular grains having an aspect ratio, which is represented by the ratio of the circle-corresponding diameter of the major face of the grain to the thickness of the grain, of 1 or more. In these references, however, there is no disclosure relating to multi-layered tabular grains having {100} face as a major face.

The known, multi-layered silver iodobromide grains have high sensitivity and high resistance to pressure fog but have lower solubility than silver chloride grains. Therefore, though having high sensitivity, these are not suitable for photographic materials to be processed rapidly. When photographic materials having such silver iodobromide grains are processed, iodide ions and bromide ions accumulate in the developer being used thereby lowering the activity of the developer and retarding the development of the materials. In addition, the fixation of silver iodobromide emulsions progresses slowly and therefore the emulsions are not applicable to rapid processing.

There are many references relating to silver halide tabular grains having a high silver chloride content. As references relating to silver halide tabular grains having a major face of {111}, for example, mentioned are JP-B-64-8326, JP-B-64-8325, JP-B-64-8324 (the term "JP-B" as referred to herein means an "examined Japanese patent publication), JP-A-1-250943, JP-B-3-14328, JP-B-4-81782, JP-B-5-40298, JP-B-5-39459, JP-B-5-12696, JP-A-63-213836, JP-A-63-218938, JP-A-63-281149, and JP-A62-218959.

As references relating to silver halide tabular grains having a major face of {100}, mentioned are JP-A-5-204073 (corresponding to U.S. Pat No. 5,292,632), JP-A-51-88017 (corresponding to U.S. Pat No. 4,063,951), JP-A-63-24238 (corresponding to U.S. Pat No. 4,777,125), etc.

In JP-A-5-281640, referred to are core-shell type multi-layered grains. However, there is no reference relating to selenium and/or tellurium-sensitized emulsions of multi-layered or two-layered high silver chloride tabular grains having a major face of {100}.

It is a known that, in the crystal of a silver chloride grain, {100} face is more stable crystal habit than {111} face and the former is advantageous for adsorption of dye thereonto, etc. Therefore, it is easy to obtain silver chloride grains having high sensitivity. However, silver chloride grains having a uniform structure are often fogged when they are chemically sensitized. In addition, since the uniform silver chloride grains are not specifically constructed in such a way that the electric separation of electrons and positive holes to be formed in the grains when the grains have absorbed light is accelerated, the formation of latent images in or on the grains is often inefficient.

Moreover, silver chloride grains having elevated sensitivity are easily fogged under pressure. Therefore, it has heretofore been impossible to realize silver chloride grains having elevated sensitivity and elevated resistance to pressure fog.

We, the present inventors have found that, when the outermost layer of multi-layered silver halide grains is made to have a largest Br content rate, then the adsorption of dye onto the grains is enhanced to the same degree as that onto pure silver bromide grains. In addition, we also have found that such multi-layered silver halide grains where the outermost layer is made to have a high Br content rate are much more preferably used than pure silver bromide grains in photographic materials which are processable rapidly while needing reduced amounts of replenishers to the processing solutions being used for processing them.

In the present specification, "Br content rate" means a Br mol rate based on a silver halide composition constituting a region (layer) in a silver halide grain. For example, the "Br content rate" is "y" when the silver halide composition is AgIxBryClz and x+y+z=1.

When such multi-layered silver halide grains having the highest Br content rate region on the surfaces of the grains are exposed to light, positive holes generated by the exposure are gathered in the region and are forcedly separated from electrons while the rebinding of the positive holes and the electrons is inhibited. Accordingly, the formation of latent images on the grains is enhanced.

The existence of the high Br region content rate on the surface of the grain is equal to the introduction of the gap of halide composition and also the introduction of crystal defects (dislocation, etc.) inside of the grain, and it is well known that the introduction of these has the effect to reduce pressure fog. We, the present inventors have also found, as a result of our assiduous studies, that high silver chloride tabular grains having a major face of {100} outstandingly exhibit this effect.

In addition, we, the present inventor have also found that, when the formation of the shell around the core in producing core-shell type silver halide grains is conducted by conventional ion implantation under too high super-saturated conditions, it often detracts from the anisotropic growth of the growing grains with the result that the thus-grown grains defectively become thick.

SUMMARY OF THE INVENTION

An object of the present invention is to provide a silver halide photographic emulsion which has high sensitivity and high covering power but is only lightly fogged and in which the intergranular uniformity of the halide composition in the constitutive grains is good. ("Covering power" is meant to indicate the optical density of a developed photographic material per the unit amount of silver therein developed.)

Another object of the present invention is to provide a silver halide photographic material which comprises the emulsion and which therefore can be processed rapidly.

Still another object of the present invention is to provide a photographic emulsion and also a photographic material which satisfy the above-mentioned requirements and which have high resistance to pressure fog.

In order to attain these objects, we, the present inventors have assiduously studied and, as a result, have found that these objects can be attained by a silver halide emulsion which comprises multi-layered silver halide grains (i) having {100} face as a major face, (ii) having a total Cl content of 20 mol %/mol of Ag or more and (iii) having an aspect ratio of 2 or more, wherein the silver halide emulsion has been sensitized by selenium and/or tellurium sensitization, and also by a silver halide photographic material comprising the emulsion.

As a first embodiment of the present invention, the multi-layered silver halide grains in the emulsion are core-shell grains that have been produced by forming a shell around the core grain in such a way that the aspect ratio of the shell-coated grain is larger than that of the core grain.

As a second embodiment of the present invention, the surfaces (outermost layers) of the multi-layered silver halide grains in the emulsion each have a Br content of 20 mol %/mol of Ag or more.

As a third embodiment of the present invention, the surfaces (outermost layers) of the multi-layered silver halide grains in the emulsion each have a Br content of 50 mol %/mol of Ag or more.

As a fourth embodiment of the present invention, the multi-layered silver halide grains in the emulsion are two-layered core-shell grains.

As a fifth embodiment of the present invention, the growth of the shell around the core grain to produce the multi-layered silver halide grains constituting the emulsion is conducted at pCl of 1.60 or more.

As a sixth embodiment of the present invention, the growth of the shell around the core grain to produce the multi-layered silver halide grains constituting the emulsion is conducted by adding fine silver halide grains to the core grains.

The present invention also provides a silver halide photographic material comprising the emulsion according to any of the above-mentioned embodiments.

DETAILED DESCRIPTION OF THE INVENTION

The present invention is described in detail hereinunder.

The multi-layered silver halide grains to be in the emulsion of the present invention each preferably have a total Cl content of from 20 mol % to 98 mol %, more preferably from 30 mol % to 90 mol %, even more preferably from 40 mol % to 90 mol %, per mol of silver in the grain. The grains each preferably have a total Br content of from 1 mol % to 80 mol %, more preferably from 5 mol % to 70 mol %, even more preferably from 10 mol % to 60 mol %, per mol of silver in the grain. The aspect ratio of the tabular silver halide grain as referred to herein means a value to be obtained by dividing the diameter of the circle corresponding to the projected area of the grain by the thickness of the grain. The projected area of the tabular grain as referred to herein means a projected area of each of AgX emulsion grains which have been disposed on a substrate in such a way that the grains do not overlap with one another and that the major faces of the tabular grains are made parallel to the surface of the substrate. The diameter of the tabular grain as referred to herein means a diameter of a circle having the same area as the projected area of the grain when the grains are observed with an electronic microscope. The thickness thereof means the distance between the major faces of the tabular grain. The thickness is preferably 0.5 μm or less, more preferably from 0.03 to 0.3 μm, even more preferably from 0.05 to 0.2 μm. The grain size of the tabular grain is preferably 10 μm or less, more preferably from 0.2 to 5 μm, in terms of the diameter of the circle corresponding to the projected area of the grain. Regarding the grain size distribution of the tabular grains, it is preferred that the grains are monodispersed in such a way that the variation coefficient of the grain size distribution (standard deviation/mean grain size) is from 0 to 0.4, preferably from 0 to 0.3, more preferably from 0 to 0.2.

The AgX emulsion of the present invention comprises at least a dispersing medium and AgX grains, in which tabular AgX grains each having a major face of {100} and having an aspect ratio (diameter/thickness) of 2 or more, preferably from 3 to 25, more preferably from 3 to 10 occupy 30% or more, preferably from 60% to 100%, more preferably from 80% to 100% of the total projected area of all the AgX grains therein.

The multi-layered silver halide grains as referred to herein means silver halide grains each having two or more layers having different halide compositions.

As one embodiment of the multi-layered silver halide grains of the present invention, mentioned are so-called "core-shell grains".

The core as referred to herein indicates a portion formed by adding Ag up to 20 mol %, preferably up to 10 mol %, of the total Ag amount used for forming the silver halide grain of the present invention. The halide compositions constituting the core are not specifically defined. Therefore, the core may comprise two or more portion having different halide compositions.

The shell as referred to herein indicates the region existing around the core and having a halide composition different from that of the outermost layer of the core.

The shell may have a two-layered or more multi-layered structure. Where the shell has such a multi-layered structure, the plural layers constituting the shell are referred to as the first shell layer, the second shell layer, the third shell layer . . . from the innermost layer of the shell. Where the shell is composed of such plural layers, the first shell layer must have a halide composition different from that of the outermost layer of the core and the second, third and other shell layers each must have a halide composition different from that of the adjacent shell layers. In this case, however, it is not always necessary that the halide compositions of the second, third and other shell layers are different from those of the core. Since the core-shell silver halide grains for use in the present invention are defined as those mentioned hereinabove, silver halide grains in which the halide composition of the outermost layer of the core having a silver content of 20% or less, preferably 10% or less of the total silver constituting the grain is the same as that of the outer region of the core are not the core-shell silver halide grains as referred to herein.

The multi-layered silver halide grains for use in the present invention are preferably such that the ratio of the aspect ratio of the core grain to the aspect ratio of the shell-coated grain is 0.95 or less, more preferably 0.90 or less, even more preferably 0.85 or less.

The emulsion of the present invention is chemically sensitized. The conditions for the chemical sensitization are not specifically defined. However, it is preferred that the chemical sensitization of the emulsion is conducted at pAg of from 6 to 11, preferably from 7 to 10 and at a temperature of from 40° to 95° C., preferably from 45° to 85° C.

The present invention is characterized in that the emulsion is sensitized with a selenium sensitizer and/or a tellurium sensitizer.

The details of preferred embodiments of such selenium sensitization and tellurium sensitization to be employed in the present invention as well as compounds preferably used therein are described, for example, in JP-A-3-116132, JP-A-5-113635, JP-A-5-165136, JP-A-5-165137, JP-A-5-134345, etc.

Preferred selenium sensitizers to be used in the present invention are compounds of formula (I) or (II) in JP-A-5-165137 such as compounds (I-1) to (I-20) and compounds (II-1) to (II-19) concretely disclosed therein. As examples of tellurium sensitizers usable in the present invention, mentioned are compounds of formulae (IV) and (V) in JP-A 5-134345 such as compounds (IV-1) to (IV-22) and compounds (V-1) to (V-16) disclosed therein.

Selenium compounds (I) to (X) mentioned below are especially preferably used in the present invention as selenium sensitizers. Tellurium compounds (I) to (X) also mentioned below are especially preferably used in the present invention as tellurium sensitizers.

Selenium Compound (I):

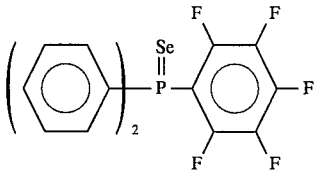

Selenium Compound (II):

KSeCN

Selenium Compound (III):

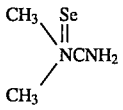

Selenium Compound (IV):

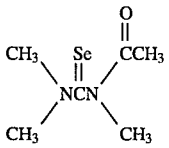

Selenium Compound (V):

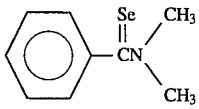

Selenium Compound (VI):

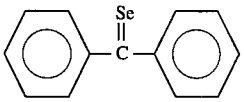

Selenium Compound (VII):

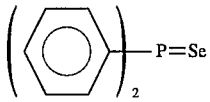

-continued

Selenium Compound (VIII):

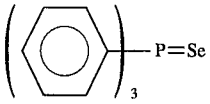

Selenium Compound (IX):

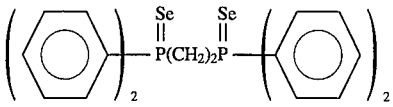

Selenium Compound (X):

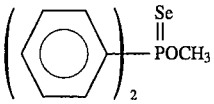

Tellurium Compound (I):

$((i)C_3H_7)_2PC_4H_9(i)$ (Te)

Tellurium Compound (II):

$((i)C_4H_9)_2PC_4H_9(n)$ (Te)

Tellurium Compound (III):

$((i)C_3H_7)_2PC_4H_9(n)$ (Te)

Tellurium Compound (IV):

$((i)C_3H_7)_3P{=}Te$

Tellurium Compound (V):

$((i)C_3H_7P(C_4H_9(i))_2$ (Te)

Tellurium Compound (VI):

$C_2H_5P(N(CH_3)_2)_2$ (Te)

Tellurium Compound (VII):

$(C_2H_5)_2PN(C_2H_5)_2$ (Te)

Tellurium Compound (VIII):

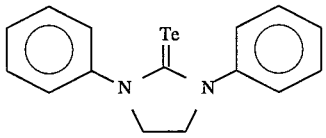

Tellurium Compound (IX):

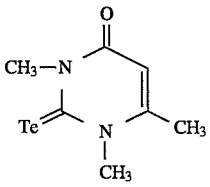

-continued

Tellurium Compound (X):

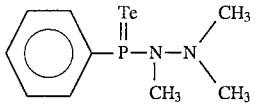

The amounts of the selenium sensitizer and the tellurium sensitizer for use in the present invention vary, depending on the silver halide grains in the emulsion to be sensitized therewith, the conditions for the chemical sensitization, etc. In general, however, the sensitizer may be used in an amount of about from $10^{-8}$ mol to $10^{-2}$ mol, preferably about from $10^{-7}$ mol to $5\times10^{-3}$ mol, per mol of the silver halide in the emulsion.

The emulsion of the present invention is preferably subjected to reduction sensitization. The reduction sensitization may be conducted, for example, according to the methods described in JP-A-2-191938, JP-A2-136852 and JP-B-57-33572, using a reducing agent selected from, for example, ascorbic acid and its derivatives, thiourea dioxide, stannous chloride, aminoiminomethanesulfinc acid, hydrazine derivatives, borane compounds, silane compounds, polyamine compounds, etc. The reduction sensitization may also be effected by ripening the emulsion while keeping the pH of the emulsion at 7 or more or by keeping the pAg of the emulsion at 8.3 or less. To sensitize the emulsion by reduction sensitization, it is also possible to introduce a single addition part of silver ion to the silver halide grains during the formation of the grains.

However, it is desirable to use a reducing agent selected from ascorbic acid and its derivatives and thiourea dioxide for subjecting the emulsion to reduction sensitization in order that the influence of the reduction sensitization on the formation and the growth of the emulsion grains is retarded and that the reduction sensitization is effected under controlled conditions. The amount of the reducing sensitizer to be used varies, depending on the type of the sensitizer itself. However, it is desirable that the amount is from $10^{-7}$ mol to $10^{-2}$ mol per mol of Ag in the emulsion. The reduction sensitization can be effected at any stage during the formation of the emulsion grains, and it can be effected even after the formation of the emulsion grains but before the chemical sensitization of the emulsion.

The surfaces of the multi-layered silver halide grains in the emulsion of the present invention each preferably have a Br content of 20 mol % or more, more preferably 50 mol % or more, even more preferably 70 mol % or more, per mol of silver in the grain. The silver halide content in one shell layer of the multi-layered silver halide grain is 0.1 mol % or more, preferably from 0.2 mol % to 95 mol %, more preferably from 1 mol % to 90 mol %, relative to the total silver halide content in the grain. The difference in the Br content rate between the layer of the grain having the highest Br content rate and that having the lowest Br content rate is preferably from 10 mol % to 100 mol %, more preferably from 30 mol % to 100 mol %, even more preferably from 50 mol % to 100 mol %. One embodiment of the multi-layered silver halide grain is such that the shell has a multi-layered structure composed of two or more layers in which one shell layer is a high $Br^-$ content rate layer. Another embodiment of the grain is such that the shell has a multi-layered structure composed of two or more layers in which the $Br^-$ content rate is lowered in order from the surface of the grain toward the inside thereof. It is desirable that the multi-layered silver halide grains in the emulsion of the present invention are such that the $Br^-$ content rate gap at the interface between the core and the shell is 70 mol % or less, preferably from 5 to 35 mol %. This is because, if the $Br^-$ content rate gap at the interface is too large, the core is dissolved while a shell is formed around the core with the result that the shape of the tabular grain is often deformed. The Br content rate in the shell layer having the highest Br content rate is preferably from 35 to 100 mol %, more preferably from 50 to 100 mol %, even more preferably from 75 to 100 mol %. One embodiment of the shell is such that the shell has an $I^-$ content rate of 20 mol % or less, preferably from 0.1 to 10 mol %.

In this embodiment, it is more preferred that the $I^-$ content rate in the shell is lowered in order from the surface of the shell toward the inside thereof. Especially preferably, the shell locally contains $I^-$ ions within the 10 atom-thickness layers of the silver halide, preferably within 5 atom-thickness layers of the silver halide from its surface. It is desirable that the $I^-$ ions are substantially uniformly distributed at least on the major face of the grain, and it is desirable that they are substantially uniform also in the intergrains. It is also desirable that the shell of the grain contains $SCN^-$ ions in an amount of 0.1 mol % or more, preferably from 1 to 50 mol %. In this embodiment, it is preferred that the $SCN^-$ ions are localized within the 10 atom-thickness layer of the silver halide, more preferably within 3 atom-thickness layers of the silver halide from the surface of the shell. In this embodiment, it is desirable that the $SCN^-$ ions are substantially uniformly distributed at least on the major face of the grain, and it is desirable that they are substantially uniform also in the intergrains.

The wording "substantially uniform(ly)" as referred to herein indicates an embodiment that the coefficient of variation of the $I^-$ or $SCN^-$ distribution is preferably 0.4 or less, more preferably from 0 to 0.3, even more preferably from 0 to 0.1, on the major face of the grain or in the intergrains.

As embodiments of the shape of the major faces of the multi-layered silver halide tabular grains to be in the emulsion of the present invention, there are mentioned ① an embodiment of a right-angled parallelogram (in which the ratio of the adjacent sides (edges) corresponding to the ratio of (length of the major side (edge))/(length of the minor side (edge)) in one grain is from 1 to 10, preferably from 1 to 5, more preferably from 1 to 2), ② an embodiment of a shape derived from a right-angled parallelogram by asymmetrically missing one or more of the four angles therefrom (for its details, JP-A-5-216180, Japanese Patent Application No. Hei. 5-264059 are referred to), ③ an embodiment of a shape derived from a four-sided figure by making at least two facing sides curve outwardly, ④ an embodiment of a shape derived from a right-angled parallelogram by rectangular-parallelopipedically missing one or more of the four angles therefrom, and ⑤ an embodiment of a shape derived from a right-angled parallelogram by symmetrically missing the four angles therefrom ({the ratio of (maximum deleted area/minimum deleted area) in the major face of one grain}<2). Of these, preferred are the embodiments ①, ② and ⑤. More preferred embodiments of the tabular grains are ② and ⑤ in which the grain has {111} face on the missed portion(s). The areal proportion of {111}face in the grain is preferably from 0 to 40%, more preferably from 0.5 to 20%, relative to the total surface area of the grain.

The structure of the multi-layered silver halide grain is such that distinct layers each having a different halide composition are detected in one grain by X-ray diffractometry or analytic electromicroscopy. The number of the shell layers constituting the grain is preferably one or more, more preferably two or more.

To form the multi-layered silver halide grains having the above-mentioned structure, the whole surfaces of the AgX shell layers of multi-layered silver halide grains must be grown anisotropically and preferably in such a direction that the aspect ratios of the thus-grown grains are enlarged. For this, the solution of $Ag^+$ salt and/or the solution of $X^-$ salt may be added at low supersaturation. As one example, these solutions are added at various flow rates, then the structures of the silver halide grains thus formed are examined, and the most preferred conditions for the formation of the intended grains are obtained.

One preferred embodiment of the multi-layered silver halide tabular grains to be in the emulsion of the present invention is such that the intergranular variation coefficient of the $Br^-$ content rate in the shell part of each grain (ratio of (standard deviation of the intergranular distribution of the $Br^-$ content rate in the shell part of each grain)/(mean $Br^-$ content rate)) is preferably 0.4 or less, more preferably from 0 to 0.3, even more preferably from 0 to 0.1.

$I^-$ ions can be introduced into the surface layers of the multi-layered silver halide tabular grains either by simultaneous addition of the solution of $Ag^+$ salt and the solution of $X^-$ salt by a double-jet method or by single addition of only the solution of $X^-$ salt after the growth of the grains. However, the latter is preferred to the former, since it is possible to more easily localize the $I^-$ ions added by the latter on the surfaces of the grains and therefore the intended effect can be attained even when a smaller amount of the solution is added.

The multi-layered silver halide tabular grains having the above-mentioned structure have the following advantages: Since a large part of the AgX grain is composed of AgCl, the emulsion containing the grains is developed rapidly. Therefore, the amount of the photographic material having the emulsion that is processed with a unit amount of developer is large, and the amount of the replenisher for developer can be reduced. In general, AgX grains having AgCl on their surfaces have a small degree of polarization and therefore have a drawback in that the adsorption of sensitizing dyes that adsorb onto the grains due to their van der Waals' force is weakened. However, since the $Br^-$ content rate in the surface of the tabular, multi-layered silver halide grain having the above-mentioned structure according to the present invention has been elevated, the adsorption of sensitizing dyes thereonto is enhanced. In addition, the $I^-$ content rate in the surface of the grain has been optionally elevated, by which the adsorption of sensitizing dyes thereonto is further enhanced. Since the $Br^-$ and $I^-$ ions have been localized in the surface or in the vicinity of the surface of the grain, it is possible to attain the highest effect of the present invention even though the contents of these ions are small. In addition, the $Br^-$ and $I^-$ ions existing in the surface of the grain also act to lower the solubility of the AgX grain and to prevent the emulsion comprising the grains and the photographic material having the emulsion from being fogged during the chemical sensitization of the emulsion or during the storage of the emulsion and the material. Hence, the surface characteristics of the multi-layered silver halide tabular grains to be in the emulsion of the present invention are near to those of conventional AgBrI grains.

In the process of rapidly processing a photographic material, if the initial developing speed is made high, the differentiation of the latent image to be developed from fog nuclei in the material is retarded with the result that the sensitivity of the material is lowered and the material is highly fogged. On the other hand, even if the developing speed in the latter stage of the rapid processing process is made high, such has a little influence on the material processed. However, since the multi-layered silver halide tabular grains to be in the emulsion of the present invention have been so planed that they are developed more rapidly during the latter development stage than during the initial development stage, they are out of this problem.

In addition, since the major part (preferably 60% or more, more preferably from 80 to 100%, even more preferably from 95 to 100%) of the surface of the grain of the present invention is composed of {100} faces and since the degree of polarization of such {100} face is larger than that of {111} face, the grain has the enhanced ability to adsorb sensitizing dyes thereonto. This is based on the fact that the {100} face composed of $Ag^+$ and $X^-$ ions has a larger Heitler-London's dispersing power and a larger induced dipolar moment than the {111} face composed of only $X^-$ ions. Therefore, it is possible to reduce the I– content rate and the Br– content rate in the surfaces of the {100) grains of the present invention more than those in the surfaces of conventional {111} grains.

Regarding the fact that the {100} face has a higher efficiency of color sensitization than the {111} face, the disclosures in Japanese Patent Application No. Hei. 5-246059 are referred to. The van der Waals' interacting force of the {100} face and that of the {111} face can be compared with each other, by simply comparing the degree of the dielectric constant in the direction parallel to the {100} face and that in the direction parallel to the {111} face. These dielectric constants can be obtained by forming a condenser of AgX single crystals and measuring the dielectric constant in the direction parallel to the {100} face and the dielectric constant in the direction parallel to the {111} face. In this measurement, the ionic conductive components in the AgX single crystals are removed by increasing the frequency applied to the crystals. Apart from this, it is also possible to measure the reflectivity (n) of transparent light on the clean {100} or {111} face of the AgX single crystal and to obtain the high-frequency dielectric constant of each face from the equation of $n^2$=(dielectric constant). constants of the two faces may be compared with each other.

To analyze the multi-layered silver halide tabular grains to be in the emulsion of the present invention, employable are a method of scanning analytic electromicroscopy where the cross section of the tabular grain is scanned and excited with electron beams and the emissions (for example, characteristic X-rays) from the halogen atoms in each site of the cross section are detected, and a method of secondary ion mass spectroscopy. For these methods, the disclosures in the Journal of the Photographic Society of Japan, Vol. 53, pp. 125 to 131 (1990) are referred to.

To produce the multi-layered silver halide tabular grains to be in the emulsion of the present invention, if the solution of $Ag^+$ salt and the solution of $X^-$ salt are added at too large flow rates to core grains, the AgX shell phase formed on each core becomes non-uniform between the grains formed. If so, in addition, the $I^-$ distribution in the surface of each grain formed becomes non-uniform. To produce these grains, it is desirable to employ one or more, preferably two in combination, of a method where the salt solutions are added to the reaction system containing core grains through a porous substance, preferably a hollow-tubular, porous elastic rubber film provided in the reaction system (the details of the method are described in JP-A-3-21339, JP-A-4-193336, JP-A-4-229852, and Japanese Patent Application No. 4-240283) and a uniformly mixing method such as that described in JP-A-4-283741 and Japanese Patent Application No. Hei.4-302605.

It is desirable that the formation of the shell around the core grain is conducted at pCl of 1.6 or more, preferably at pCl of from 1.6 to 2.5. It is also desirable that the other silver halide grains to be in the emulsion of the present invention are produced also at pCl falling within the same range. This is because the production of the multi-layered silver halide tabular grains to be in the emulsion of the present invention is preferably conducted under the conditions for producing cubic silver halide grains. Therefore, the $Cl^-$ concentration falling within the defined range, which is employed for producing the tabular grains, corresponds to that for producing cubic grains. The excess $Cl^-$ ions are considered to act as a kind of crystal habit-controlling agent.

To produce the multi-layered silver halide grains to be in the emulsion of the present invention, it is preferred that the growth of the shell around each core is conducted by addition of fine AgX grains to core grains.

The fine grains to be added are preferably as large as possible only within the range that they can be lost to the reaction system after the reaction, since it is desired that the degree of saturation of the reaction system is the smallest. The size of the fine grains that can be lost to the reaction system after the reaction varies, depending on the size of the {100} tabular grains being grown. Therefore, to grow the shells around the tabular grains, it is desirable that the size of the fine grains to be added is gradually enlarged with the growth of the shells around the tabular grains. Using the fine AgX grains, the shells of the tabular grains are made grow by Ostwald's ripening of the emulsion. The emulsion of such fine silver halide grains can be added either continuously or intermittently. It is possible either to continuously and immediately add the emulsion of fine silver halide grains that has been continuously prepared by mixing an $AgNO_3$ solution and an $X^-$ salt solution in a mixer provided near the reactor where the tabular silver halide grains are being grown, to the reactor, or to continuously or intermittently add the emulsion of fine silver halide grains that has been batchwise prepared in a different reactor. The emulsion of fine silver halide grains can be added to the reactor where the tabular silver halide grains are being grown, as a liquid or as a dried powder. It is desirable that the emulsion of fine silver halide grains does not substantially contain multiplet twin-crystalline grains. Multiplet twin-crystalline grains as referred to herein indicate those having two or more twin planes in one grain. The wording "does not substantially contain multiplet twin-crystalline grains" as referred to herein means that the content of such multiplet twin-crystalline grains in the emulsion is 5% or less, preferably 1% or less, more preferably 0.1% or less. In addition, it is also desirable that the emulsion of fine silver halide grains does not substantially contain also singlet twin-crystalline grains. More preferably, it is desirable that the fine silver halide grains do not substantially have any spiral dislocation. To the wording "do/does not substantially contain (have) . . . ", the same as above shall apply. The fine silver halide grains have a halide composition of AgCl, AgBr or AgBrI (where the $I^-$ content rate is preferably 20 mol % or less, more preferably 10 mol % or less), or two or more of these as mixed crystals.

As one embodiment of the present invention, the difference in the content rate of at least one or more of sulfur, selenium, tellurium, $SCN^-$, $SeCN^-$, $TeCN^-$ $CN^-$, metal ions except Ag+, and complexes of such metal ions (as ligands of the complexes, mentioned are $X^-$ ligand, $CN^-$ ligand, isocyano, nitrosyl, thionitrosyl, amine, hydroxyl), between the adjacent phases in the gaps existing in the multi-layered silver halide tabular grains to be in the emulsion of the present invention is preferably from 0.1 to 100 mol %, more preferably from 1 to 100 mol %, even more preferably from 10 to 100 mol %. Typical examples of the metal ions except $Ag^+$ are ions of metals of the Group VIII of the Periodic Table as well as ions of Cu, Zn, Cd, In, Sn, Au, Hg, Pb, Cr and Mn.

AgX grains wholly doped with such impurity ions, AgX grains doped with such impurity ions only at particular site(s) in the grain, AgX grains doped with such impurity ions locally only within the depth of 0.1 μm from the surface of the grain are also within the scope of the present invention as its embodiments. In these embodiments, the concentration of the doped ions is preferably from $10^{-8}$ to $10^{-1}$ mol/mol of AgX, more preferably from $10^{-7}$ to $10^{-2}$ mol/mol of AgX.

For concrete examples of compounds of these impurity ions and the details of the method of doping the ions into the AgX phase of AgX grains, for example, referred to are the disclosures in Research Disclosure, Vol. 307, Item 307,105 (November, 1989); U.S. Pat. Nos. 5,166,045, 4,933,272, 5,164,292, 5,132,203, 4,269,927, 4,847,191, 4,933,272, 4,981,781, 5,024,931; JP-A-4-305644, JP-A-4-321024, JP-A-1-183647, JP-A-2-20853, JP-A-1-285941, JP-A-3-1118536.

If desired, a {100} face forming promoter (crystal habit controlling agent) may be made to exist in the reaction system of forming the AgX grains during the growth of the grains, according to the definitions of the AgX grains of the present invention mentioned hereinabove. The crystal habit controlling agent is a compound that acts to lower the above-mentioned equilibrium crystal habit potential by 10 mV or more, preferably by from 30 to 200 mV, during the growth of the AgX grains. When the growth of the AgX grains is conducted in the presence of the crystal habit controlling agent, the AgX grains of the above-mentioned embodiment ② are formed more easily.

For concrete examples of the crystal habit controlling agent, for example, referred to are the disclosures in U.S. Pat. Nos. 4,399,215, 4,414,306, 4,400,463, 4,713,323, 4,804,621, 4,783,398, 4,952,491, 4,983,508; Journal of Imaging Science, Vol. 33, 13 (1989 ); ibid., Vol. 34, 44 (1990 ); Journal of Photographic Science, Vol. 36, 182 (1988).

Since the majority of the surface of the AgX grain is composed of {100} faces, the adsorption of gelatin onto the Ag+ ions existing on the surface of the grain via the adsorbing groups (e.g., methionine group) of gelatin is strong. For this reason, the adsorption of other photographic additives such as color-sensitizing dyes, antifoggants, etc. onto the surface of the grain is often retarded. In such a case, it is recommended to select, as the dispersing medium for the AgX grains, gelatin having an optimum methionine content. Concretely, one embodiment is such that the mean methionine content of gelatin in the AgX emulsion layer constituting the photographic material of the present invention is preferably from 0 to 50 μmol/g, more preferably from 3 to 30 μmol/g.

The AgX emulsion of the present invention may be sensitized by adding thereto from $10^{-8}$ to $10^{-2}$ mol, per mol of AgX, of a chemical sensitizer and also sensitizing dye(s) preferably in an amount of from 5 to 100% of the saturated adsorption thereof.

To form the AgX grains having halide gaps in their nuclei, employable are (i) a method where nuclei having halide gaps therein are formed in the {100} forming area, and then the nuclei are ripened and thereafter grown in the {111} forming area, and (ii) a method where nuclei having halide gaps therein are formed in the {111} forming area, and then the nuclei are ripened and thereafter grown in the {100} forming area, in addition to the above-mentioned embodiments. The method (ii) gives twin-plane grains. Under the condition of the method (ii), in general, edge dislocation (Taylor-Orowan dislocation) occurs which does not give tabular grains. Therefore, it is considered that mere edge dislocation could not be the cause for forming the tabular AgX grains referred to herein.

The growing mode of the AgX grains in the direction of their edges can be confirmed by adding an AgX layer to each nucleus, while making a difference in the iodide content rate between the two by from 0.5 to 3 mol % and growing the layer on the nucleus, followed by (a) observing the emission of the thus-grown grains at a low temperature (for example, refer to the disclosure in Journal of Imaging Science, Vol. 31, 15–36 (1987)) or by (b) observing the interface between the gaps (having different iodide content rates) on the photographic image of the grains taken by direct low-temperature transmission electromicroscopy.

Using the grains thus formed according to any of the above-mentioned methods as the host grains, epitaxial grains may be formed on the edges and/or the corners of the host grains to produce the AgX grains of the present invention. Using the grains as the cores, it is also possible to produce the AgX grains having internal dislocation lines therein. In addition to these means, it is also possible to use the grains as substrate grains and to laminate AgX layer(s) having a halide composition different from that of the substrate grains thereby forming various AgX grains having various known grain structures. For these, the disclosures in various references such as those mentioned hereinunder are referred to. In the emulsion grains thus obtained, in general, chemically-sensitized nuclei are formed.

In this case, it is desirable that the sites where the chemically-sensitized nuclei are formed and the number of the nuclei formed, per $cm^2$, are controlled. For this, referred to are the disclosures in JP-A-2-838, JP-A-2-146033, JP-A-1-201651, JP-A-3-121445, JP-A-64-74540, Japanese Patent Application Nos. 3-73266, 3-140712, 3-115872.

The AgX emulsion grains produced according to the present invention may be blended with one or more other AgX emulsion grains to produce blend emulsions. The mixing ratio in such a blend emulsion may fall within the range between 1.0/1 and 0.01/1 (as the former to the latter), and the most suitable mixing ratio may be selected from the range.

Additives to be in the photographic material of the present invention are not specifically defined. For example, those mentioned in the following references can be employed.

| Items | References |
|---|---|
| 1) Silver halide emulsions and methods for producing them | JP-A-2-68539, from page 8, right bottom column, line 6 from below to page 10, right top column, line 12; JP-A-3-24537, from page 2, right bottom column, line 10 to page 6, right top column, line 1, and from page 10, left top column, line 16 to page 11, left bottom column, line 19; JP-A-4-107424 |
| 2) Chemical sensitization | JP-A-2-68539, page 10, from right top column, line 13 to left top column, line 16; Japanese Patent Application No. 3-105035 |
| 3) Antifoggants, Stabilizers | JP-A-2-68539, from page 10, left bottom column, line 17 to page 11, left top column, line 7, and from page 3, left bottom column, line 2 to page 4, left bottom column |
| 4) Color tone improving agents | JP-A-62-276539, from page 2, left bottom column, line 7 to page 10, left bottom column, line 20; JP-A-3-94249, from page 6, left bottom column, line 15 to page 11, right top column, line 19 |
| 5) Color sensitizing dyes | JP-A-2-68539, from page ;4, right bottom column, line 4 to page 8, right bottom column |
| 6) Surfactants, Antistatic agents | JP-A-2-68539, from page 11, left top column, line 14 to page 12, left top column, line 9 |
| 7) Mat agents, Lubricants, Plasticizers | JP-A-2-68539, page 12, from left top column, line 10 to right top column, line 10, and page 14, from left bottom column, line 10 to right bottom column, line 1 |
| 8) Hydrophilic colloids | JP-A-2-68539, page 12, from right top column, line 11 to left bottom column, line 16 |
| 9) Hardeners | JP-A-2-68539, from page 12, left bottom column, line 17 to page 13, right top column, line 6 |
| 10) Supports | JP-A-2-68539, page 13, right top column, line 7 to 20 |
| 11) Methods of cutting crossover | JP-A-2-264944, from page 4, right top column, line 20 to page 14, right top column |
| 12) Dyes, Mordanting agents | JP-A-2-68539, from page 13, left bottom column, line 1 to page 14, left bottom column, line 9; JP-A-3-24537, from page 14, left bottom column to page 16, right bottom column |
| 13) Poly-hydroxybenzenes | JP-A-3-39948, from page 11, left top column to page 12, left bottom column; EP 452772A |
| 14) Layer constructions | JP-A-3-198041 |
| 15) Methods of development | JP-A-2-103037, from page 16, right top column, line 7 to page 19, left bottom column, line 15; JP-A-2-115387, from page 3, right bottom column, line 5 to page 6, right top column, line 10 |

The present invention is described in more detail by means of the following examples, which, however, are not intended to restrict the scope of the present invention.

EXAMPLE 1

Preparation of Emulsion (A) of the Invention:

1582 ml of aqueous gelatin solution (containing 19.5 g of gelatin-1 (deionized, alkali-processed bone gelatin having a methionine content rate of about 40 μmol/g) and 7.8 ml of 1N $HNO_3$ solution and having pH of 4.3) and 13 ml of NaCl-1 solution (containing 10 g of NaCl in 100 ml) were put into a reactor, and 15.6 ml of Ag-1 solution (containing 20 g of $AgNO_3$ in 100 ml) and 15.6 ml of X-1 solution (containing 7.05 g of NaCl in 100 ml) were added thereto by a double jet method both at a flow rate of 62.4 ml/min, while keeping the temperature at 40° C. After stirred for 3 minutes, 28.2 ml of Ag-2 solution (containing 2 g of $AgNO_3$ in 100 ml) and 28.2 ml of X-2 solution (containing 1.4 g of KBr in 100 ml) were added thereto by a double jet method both at a flow rate of 80.6 ml/min. After stirred for 3 minutes, 46.8 ml of Ag-1 solution and 46.8 ml of X-1 solution were added thereto by a double jet method both at a flow rate of 62.4 ml/min. After stirred for 2 minutes, 203 ml of aqueous gelatin solution (containing 13 g of gelatin-1 and 1.3 g of NaCl and containing 1N NaOH solution by which the gelatin solution was adjusted to have pH of 6.5) were added thereto, by which the reaction system was made to have pCl of 1.75. Then, this was heated at 75° C. and ripened for 3 minutes at pCl of 1.65. Subsequently, an emulsion (E-1) of fine AgCl grains having a mean grain diameter of 0.1 μm was added thereto at a flow rate of $2.68\times10^{-2}$ mol(AgCl )/min over a period of 20 minutes to produce cores. 3 minutes after the addition, Ag-3 solution (containing 50 g of $AgNO_3$ in 100 ml) and X-3 solution (containing 11.7 g of NaCl and 11.9 g of KBr in 100 ml) were added thereto by C.D.J. (controlled double jet method) both at a constant flow rate over a period of 17 minutes until the amount of Ag-3 solution added became 17.3 ml, by which the cores were grown. 5 minutes after the addition, Ag-3 solution and X-4 solution (containing 5.9 g of NaCl and 23.9 g of KBr in 100 ml) were added thereto by C.D.J. both at a constant flow rate over a period of 17 minutes until the amount of Ag-3 solution added became 17.3 ml, by which the cores were further grown. 5 minutes after the addition, Ag-3 solution and X-5 solution (containing 35.8 g of KBr in 100 ml) were added thereto by C.D.J. both at a constant flow rate over a period of 17 minutes until the amount of Ag-3 solution added became 17.3 ml, by which the cores were further grown. During these additions by C.D.J., the pCl of the reaction system was kept at 1.65 by the addition of the Ag-X solution thereto. This was ripened for 90 minutes after the final addition and a flocculating agent was added thereto. Then, this was cooled to 35° C. and washed with water by flocculation. An aqueous gelatin solution was added to this, which was then adjusted at pH of 6.0 at 60° C. The transmission electronic microscopic image (hereinafter referred to as TEM image) of the replicas of the grains in the emulsion thus formed was observed. The emulsion contained multi-layered silver chlorobromide {100} tabular grains having an AgBr content of 20 mol % based on silver. The morphological characteristic values of the grains were as follows:

[(total projected area of {100} tabular grains having an aspect ratio of 2 or more)/(total projected area of all AgX grains)]×100=al=94

[mean aspect ratio (mean diameter/mean thickness) of {100} tabular grains having an aspect ratio of 2 or more]=a2=7.9

[mean diameter of {100} tabular grains having an aspect ratio of 2 or more]=a3=1.58 μm

[ratio of the major edge to the minor edge in the major face of {100} tabular grains having an aspect ratio of 2 or more]=a4=1.96

[mean thickness of {100} tabular grains having an aspect ratio of 2 or more]=a5=0.18 μm Preparation of Emulsion (B) of the Invention:

1582 ml of aqueous gelatin solution (containing 19.5 g of gelatin-1 (deionized, alkali-processed bone gelatin having a methionine content rate of about 40 μmol/g) and 7.8 ml of 1N $HNO_3$ solution and having pH of 4.3) and 13 ml of NaCl-1 solution (containing 10 g of NaCl in 100 ml) were put into a reactor, and 15.6 ml of Ag-1 solution (containing 20 g of $AgNO_3$ in 100 ml) and 15.6 ml of X-1 solution (containing 7.05 g of NaCl in 100 ml) were added thereto by a double jet method both at a flow rate of 62.4 ml/min, while keeping the temperature at 40° C. After stirred for 3 minutes, 28.2 ml of Ag-2 solution (containing 2 g of $AgNO_3$ in 100 ml) and 28.2 ml of X-2 solution (containing 1.4 g of KBr in 100 ml) were added thereto by a double jet method both at a flow rate of 80.6 ml/min. After stirred for 3 minutes, 46.8 ml of Ag-1 solution and 46.8 ml of X-1 solution were added thereto by a double jet method both at a flow rate of 62.4 ml/min. After stirred for 2 minutes, 203 ml of aqueous gelatin solution (containing 13 g of gelatin-1 and 1.3 g of NaCl and containing 1N NaOH solution by which the gelatin solution was adjusted to have pH of 6.5) were added thereto, by which the reaction system was made to have pCl of 1.75. Then, this was heated at 75° C. and ripened for 3 minutes at pCl of 1.65. Subsequently, an emulsion (E-1) of fine AgCl grains having a mean grain diameter of 0.1 μm was added thereto at a flow rate of $2.68\times10^{-2}$ mol(AgCl )/min over a period of 20 minutes. 3 minutes after the addition, (E-1) was added thereto at a flow rate of $1.02\times10^{-3}$ mol/min over a period of 3 minutes, while at the same time an emulsion (E-2) of fine AgBr grains having a mean grain diameter of 0.05 μm was added thereto at a flow rate of $5.2\times10^{-4}$ mol/min over a period of 3 minutes. 5 minutes after the addition, (E-1) was added thereto at a flow rate of $5.2\times10^{-4}$ mol/min over a period of 3 minutes, while at the same time (E-2) was added thereto at a flow rate of $1.02\times10^{-3}$ mol/min over a period of 3 minutes. 5 minutes after the addition, (E-2) was added thereto at a flow rate of $1.53\times10^{-2}$ mol(AgBr)/min over a period of 3 minutes. After the final addition this was ripened for 90 minutes, and a flocculating agent was added thereto. Then, this was cooled to 35° C. and washed with water by flocculation. An aqueous gelatin solution was added to this, which was then adjusted at pH of 6.0 at 60° C. The TEM image of the replicas of the grains in the emulsion thus formed was observed. The emulsion contained multi-layered silver chlorobromide {100} tabular grains having an AgBr content of 20 mol % based on silver. The morphological characteristic values of the grains were as follows:

a1=93 a2=9.5 a3=1.62 μm a4=1.95 a5=0.17 μm

Preparation of Emulsion (C) of the Invention:

1582 ml of aqueous gelatin solution (containing 19.5 g of gelatin-1 (deionized, alkali-processed bone gelatin having a methionine content of about 40 μmol/g) and 7.8 ml of 1N $HNO_3$ solution and having pH of 4.3) and 13 ml of NaCl-1 solution (containing 10 g of NaCl in 100 ml) were put into a reactor, and 15.6 ml of Ag-1 solution (containing 20 g of $AgNO_3$ in 100 ml) and 15.6 ml of X-1 solution (containing 7.05 g of NaCl in 100 ml) were added thereto by a double jet method both at a flow rate of 62.4 ml/min, while keeping the temperature at 40° C. After stirred for 3 minutes, 28.2 ml of Ag-2 solution (containing 2 g of $AgNO_3$ in 100 ml) and 28.2 ml of X-2 solution (containing 1.4 g of KBr in 100 ml) were added thereto by a double jet method both at a flow rate of 80.6 ml/min. After stirred for 3 minutes, 46.8 ml of Ag-1 solution and 46.8 ml of X-1 solution were added thereto by a double jet method both at a flow rate of 62.4 ml/min. After stirred for 2 minutes, 203 ml of aqueous gelatin solution (containing 13 g of gelatin-1 and 1.3 g of NaCl and containing 1N NaOH solution by which the gelatin solution was adjusted to have pH of 6.5) were added thereto, by which the reaction system was made to have pCl of 1.75. Then, this was heated at 75° C. and ripened for 3 minutes at pCl of 1.65. Subsequently, an emulsion (E-1) of fine AgCl grains having a mean grain diameter of 0.1 μm was added thereto at a flow rate of $2.68\times10^{-2}$ mol(AgCl )/min over a period of 20 minutes. 3 minutes after the addition, Ag-3 solution (containing 50 g of $AgNO_3$ in 100 ml) and X-3 solution (containing 11.7 g of NaCl and 11.9 g of KBr in 100 ml) were added thereto by C.D.J. (controlled double jet method) both at a constant flow rate over a period of 3 minutes until the amount of Ag-3 solution added became 17.3 ml. 5 minutes after the addition, Ag-3 solution and X-4 Solution (containing 5.9 g of NaCl and 23.9 g of KBr in 100 ml) were added thereto by C.D.J. both at a constant flow rate over a period of 3 minutes until the amount of Ag-3 solution added became 17.3 ml. 5 minutes after the addition, Ag-3 solution and X-5 solution (containing 35.8 g of KBr in 100 ml) were added thereto by C.D.J. both at a constant flow rate over a period of 3 minutes until the amount of Ag-3 solution added became 17.3 ml. During these additions by C.D.J., the pCl of the reaction system was kept at 1.65. This was ripened for 90 minutes after the final addition and a flocculating agent was added thereto. Then, this was cooled to 35° C. and washed with water by flocculation. An aqueous gelatin solution was added to this, which was then adjusted at pH of 6.0 at 60° C. The TEM image of the replicas of the grains in the emulsion thus formed was observed. The emulsion contained multi-layered silver chlorobromide {100} tabular grains having an AgBr content of 20 mol % based on silver. The morphological characteristic values of the grains were as follows:

a1=93 a2=6.5 a3=1.42 μm a4=1.91 a5=0.22 μm

Preparation of Emulsion (D) of the Invention:

1582 ml of aqueous gelatin solution (containing 19.5 g of gelatin-1 (deionized, alkali-processed bone gelatin having a methionine content of about 40 μmol/g) and 7.8 ml of 1N $HNO_3$ solution and having pH of 4.3) and 13 ml of NaCl-1 solution (containing 10 g of NaCl in 100 ml) were put into a reactor, and 15.6 ml of Ag-1 solution (containing 20 g of $AgNO_3$ in 100 ml) and 15.6 ml of X-1 solution (containing 7.05 g of NaCl in 100 ml) were added thereto by a double jet method both at a flow rate of 62.4 ml/min, while keeping the temperature at 40° C. After stirred for 3 minutes, 28.2 ml of Ag-2 solution (containing 2 g of $AgNO_3$ in 100 ml) and 28.2 ml of X-2 solution (containing 1.4 g of KBr in 100 ml) were added thereto by a double jet method both at a flow rate of 80.6 ml/min. After stirred for 3 minutes, 46.8 ml of Ag-1 solution and 46.8 ml of X-1 solution were added thereto by a double jet method both at a flow rate of 62.4 ml/min. After stirred for 2 minutes, 203 ml of aqueous gelatin solution (containing 13 g of gelatin-1 and 1.3 g of NaCl and containing 1N NaOH solution by which the gelatin solution was adjusted to have pH of 6.5) were added thereto, by which the reaction system was made to have pCl of 1.75. Then, this was heated at 75° C. and ripened for 3 minutes at pCl of 1.65. Next, Ag-3 solution (containing 50 g of $AgNO_3$ in 100 ml) and X-3 solution (containing 35 g of KBr in 100 ml) were added thereto by C.D.J. (controlled double jet method) both at a constant flow rate until the amount of Ag-3 solution added became 52.0 ml. During the growth of the grains, the pCl of the reaction system was kept at 1.65. The TEM image of the replicas of the grains in the emulsion thus formed was observed. The emulsion contained multi-layered silver chlorobromide {100} tabular grains having an AgBr content of 20 mol % based on silver. The morphological characteristic values of the grains were as follows:

a1=93 a2=7.8 a3=1.58 μm a4=1.95 a5=0.18 μm

Preparation of Emulsion (E) of the Invention:

1582 ml of aqueous gelatin solution (containing 19.5 g of gelatin-1 (deionized, alkali-processed bone gelatin having a methionine content of about 40 μmol/g) and 7.8 ml of 1N $HNO_3$ solution and having pH of 4.3) and 13 ml of NaCl-1 solution (containing 10 g of NaCl in 100 ml) were put into a reactor, and 15.6 ml of Ag-1 solution (containing 20 g of $AgNO_3$ in 100 ml) and 15.6 ml of X-1 solution (containing 7.05 g of NaCl in 100 ml) were added thereto by a double jet method both at a flow rate of 62.4 ml/min, while keeping the temperature at 40° C. After stirred for 3 minutes, 28.2 ml of Ag-2 solution (containing 2 g of $AgNO_3$ in 100 ml) and 28.2 ml of X-2 solution (containing 1.4 g of KBr in 100 ml) were added thereto by a double jet method both at a flow rate of 80.6 ml/min. After stirred for 3 minutes, 46.8 ml of Ag-1 solution and 46.8 ml of X-1 solution were added thereto by a double jet method both at a flow rate of 62.4 ml/min. After being stirred for 2 minutes, 203 ml of aqueous gelatin solution (containing 13 g of gelatin-1 and 1.3 g of NaCl and containing 1N NaOH solution by which the gelatin solution was adjusted to have pH of 6.5) were added thereto, by which the reaction system was made to have pCl of 1.75. Then, this was heated at 75° C. and ripened for 3 minutes at pCl of 1.65. Subsequently, an emulsion (E-1) of fine AgCl grains having a mean grain diameter of 0.1 μm was added thereto at a flow rate of $2.68\times10^{-2}$ mol(AgCl)/min over a period of 20 minutes. 3 minutes after the addition, an emulsion (E-2) of fine AgBr grains having a mean grain diameter of 0.05 μm was added thereto at a flow rate of $1.53\times10^{-2}$ mol/min over a period of 10 minutes. After the final addition this was ripened for 90 minutes, and a flocculating agent was added thereto. Then, this was cooled to 35° C. and washed with water by flocculation. An aqueous gelatin solution was added to this, which was then adjusted at pH of 6.0 at 60° C. The TEM image of the replicas of the grains in the emulsion thus formed was observed. The emulsion contained multi-layered silver chlorobromide {100} tabular grains having an AgBr content of 20 mol % based on silver. The morphological characteristic values of the grains were as follows:

a1=93 a2=9.5 a3=1.62 μm a4=1.95 a5=0.17 μm

Preparation of Emulsion (F) of the Invention:

Emulsion (F) was prepared in the same manner as in preparation of Emulsion (D), except that the grains were grown by adding thereto Ag-3 solution (containing 50 g of $AgNO_3$ in 100 ml) and X-3 solution (containing 35 g of KBr in 100 ml) at a linearly-accelerated flow rate with an initial flow rate of 1.04 ml over a period of 10 minutes until the amount of Ag-3 solution added became 52.0 ml. The pCl value in the reaction system during the growth of the grains was kept at 1.65. The morphological characteristic values of the grains thus formed were as follows:

a1=93 a2=5.4 a3=1.34 μm a4=1.93 a5=0.25 μm

Preparation of Emulsion (G) of the Invention:

Emulsion (G) was prepared in the same manner as in preparation of Emulsion (A), except that the pCl in the reaction system during the growth of the shell of each grain was kept at 1.55. The morphological characteristic values of the grains thus formed were as follows:

a1=93 a2=4.8 a3=1.30 μm a4=1.93 a5=0.27 μm

Preparation of Comparative Emulsion (H):

Emulsion (H) was prepared in the same manner as in preparation of Emulsion (E), except that (E-1) was used in place of (E-2) by which the grains were grown. The morphological characteristic values of the grains thus formed were as follows:

a1=93 a2=9.5 a3=1.63 μm a4=1.95 a5=0.17 μm

The grains in emulsion (H) have the same halide composition both in the outermost layer of the core and in the shell, and these are different from the multi-layered grains of the present invention.

Chemical Sensitization:

The emulsions prepared hereinabove each were subjected to chemical sensitization, while stirring at 60° C. Specifically, $10^{-4}$ mol, per mol of silver halide, of thiosulfonic acid compound-I (mentioned below) was added thereto. Next, $1\times10^{-6}$ mol, per mol of Ag, of thiourea dioxide was added thereto. This was kept as it was for 2 minutes, whereupon this was sensitized by reduction sensitization. Next, $3\times10^{-4}$ mol, per mol of Ag, of 4-hydroxy-6-methyl-1,3,3a,7-tetrazaindene and also the following sensitizing dyes-1 and -2 were added thereto. In addition, calcium chloride was added thereto. Next, sodium thiosulfate ($6\times10^{-6}$ mol/mol of Ag) and selenium compound-I ($4\times10^{-6}$ mol/mol of Ag) were added thereto. Further, chloroauric acid ($1\times10^{-5}$ mol/mol of Ag) and potassium thiocyanate ($1\times10^{-3}$ mol/mol of Ag) were added thereto. After 40 minutes, this was cooled to 35° C.

In this way, the emulsions were chemically subjected.

Thiosulfonic Acid Compound-I:

$C_2H_5SO_2SNa$

Sensitizing Dye-1:

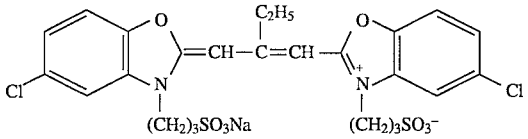

-continued $1\times10^{-3}$ mol/mol of Ag

Sensitizing Dye-2:

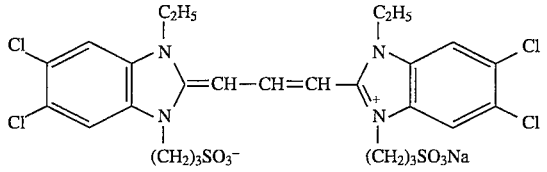

$1\times10^{-5}$ mol/mol of Ag

Preparation of Coating Liquid for Emulsion Layer:

The following chemicals were added to each of the emulsions that had been chemically sensitized as above to prepare coating liquids for emulsion layers. The amount of each chemical mentioned below is per mol of the silver halide in each emulsion.

| | |
|---|---|
| Gelatin (including gelatin in the emulsion) | 111 g |
| Dextran (having a mean molecular weight of 39,000) | 21.5 g |
| Sodium polyacrylate (having a mean molecular weight of 400,000) | 5.1 g |
| Sodium polystyrenesulfonate (having a mean molecular weight of 600,000) | 1.2 g |
| Hardening agent, 1,2-bis(vinylsulfonylacetamido)ethane (This was added in such an amount that the swelling degree of the emulsion layer coated might be 230%.) | |
| Compound-I | 42.1 mg |
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |

(The coating liquid was adjusted to have pH of 6.1 by adding NaOH thereto.)

Compound-I:

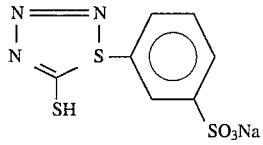

Compound-II:

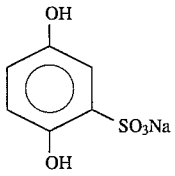

Compound-III:

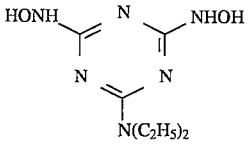

-continued

Compound-IV:

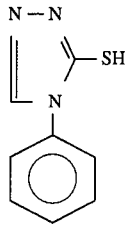

Compound-V:

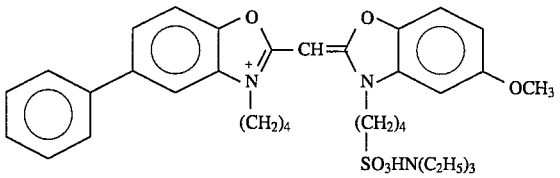

Compound-VI:

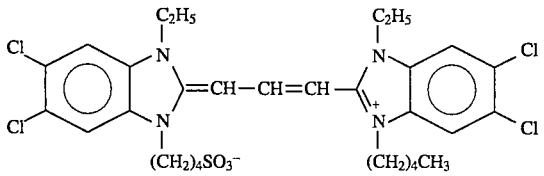

Compound-VII:

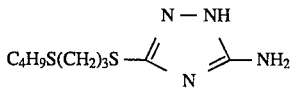

Compound-VIII:

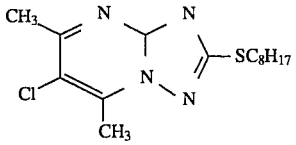

Dye emulsion (A) containing dye-I mentioned below was added to the coating liquid in such an amount that the emulsion layer coated on one surface might contain 10 mg/m$^2$ of dye-I.

Dye-I:

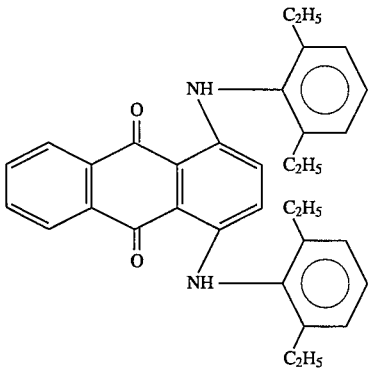

Preparation of Dye Emulsion (A):

60 g of dye-I mentioned above, 62.8 g of high boiling point organic solvent-I mentioned below, 62.8 g of high boiling point organic solvent-II mentioned below and 333 g of ethyl acetate were dissolved at 60° C. Next, 65 cc of 5% aqueous solution of sodium dodecylbenzenesulfonate, 94 g of gelatin and 581 cc of water were added thereto and emulsified and dispersed in a dissolver at 60° C. for 30 minutes. Next, 2 g of the following compound-VI and 6 liters of water were added thereto and cooled to 40° C. Next, using an ultrafilter Labomodule ACP1050 (produced by Asahi Chemical Co.), this was concentrated to 2 kg. One g of compound-VI was added to the resulting concentrate. In this way, dye emulsion (A) was obtained.

High Boiling Point Organic Solvent-I:

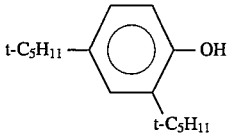

High Boiling Point Organic Solvent-II:

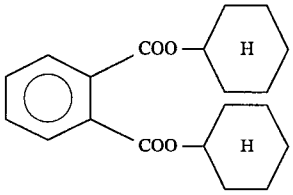

Compound-VI:

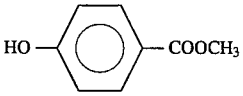

Preparation of Coating Liquid for Surface-protecting Layer:

The following components were mixed to prepare a coating liquid for surface-protecting layer. The amount of each component mentioned below is represented by g/m$^2$.

| | |
|---|---|
| Gelatin | 0.780 |
| Sodium polyacrylate (having a mean molecular weight of 400,000) | 0.035 |
| Sodium polystyrenesulfonate (having a mean molecular weight of 600,000) | 0.0012 |
| Polymethyl methacrylate (having a mean grain size of 3.7 μm) | 0.072 |
| Coating aid-I | 0.020 |
| Coating aid-II | 0.037 |
| Coating aid-III | 0.0080 |
| Coating aid-IV | 0.0032 |
| Coating aid-V | 0.0025 |
| Compound-VII | 0.0022 |
| Proxel | 0.0010 |

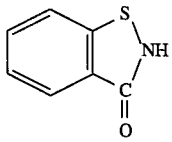

(The coating liquid was adjusted to have pH of 6.8 by adding NaOH thereto.)

-continued

Coating aid-I:

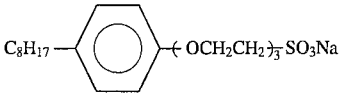

Coating aid-II $$C_{16}H_{33}O(CH_2CH_2O)_{10}H$$

Coating aid-III:

$$C_{17}H_{33}CON(CH_3)CH_2CH_2SO_3Na$$

Coating aid-IV:

$$C_8F_{17}SO_2N(C_3H_7)(CH_2CH_2O)_{10}H$$

Coating aid-V:

$$C_8F_{17}SO_2N(C_3H_7)(CH_2CH_2O)_4(CH_2)_4SO_3Na$$

Compound-VII:

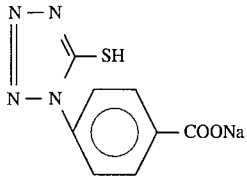

Preparation of Support:

(1) Preparation of Dye Dispersion (B) to be in Subbing Layer:

The following dye-II was milled in a ball mill according to the method described in JP-A 63-197943.

Dye-II:

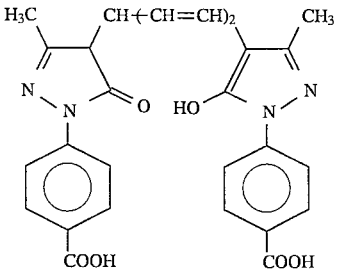

Precisely, 434 cc of water and 791 cc of 6.7-% aqueous solution of Triton X-200 (TX-200, trade name; surfactant) were put into a 2-liter ball mill. 20 g of the dye were added to the solution in the ball mill. 400 ml of zirconium oxide ($ZrO_2$) beads (having a diameter of 2 mm) were put into the ball mill, and the content in the mill was milled for 4 days. After this, 160 g of 12.5-% gelatin were added thereto. After defoamed, the $ZrO_2$ beads were removed by filtration. The thus-obtained dye dispersion was observed. The dye grains had widely varying grain sizes falling between 0.05 μm and 1.15 μm and had a mean grain size of 0.37 μm.

The dye dispersion was centrifuged and large dye grains having a grain size of 0.9 μm or more were removed.

In this way, dye dispersion (B) was obtained.

(2) Preparation of Support:

A biaxially-stretched polyethylene terephthalate film having a thickness of 175 μm was subjected to corona discharging and then coated with a coating liquid having the composition mentioned below at a thickness of 4.9 cc/m$^2$, using a wire converter, and dried at 185° C. for one minute. Thus, a first subbing layer was coated on one surface of the support.

Next, the other surface of the support was coated with the same first subbing layer. The polyethylene terephthalate film used contained 0.04% by weight of dye-I.

| Coating Liquid for First Subbing Layer: | |
|---|---|
| Solution of butadiene-styrene copolymer latex (having a solid content of 40% and having a ratio of butadiene/styrene of 31/69 by weight) | 158 cc |
| 4% Solution of 2,4-dichloro-6-hydroxy-s-triazine sodium salt | 41 cc |
| Distilled water | 801 cc |

The latex solution contained, as an emulsifying and dispersing agent, the following compound in an amount of 0.4% by weight relative to the latex solid content.

Emulsifying and dispersing agent:

$$nC_6H_{13}OOCCH_2 \\ | \\ nC_6H_{13}OOCCH-SO_3Na$$

(3) Coating of Subbing Layer on Support:

A second subbing layer having the composition mentioned below was coated on one first subbing layer and then on the other, using a wire bar coater, and dried at 155° C. The amount of each component is represented by mg/m$^2$.

| | |
|---|---|
| Gelatin | 80 |
| Dye dispersion (B) | 8 (as solid dye) |
| Coating aid-VI | 1.8 |
| Compound-VIII | 0.27 |
| Mat agent (polymethyl methacrylate having a mean grain size of 2.5 μm) | 2.5 |

Coating aid-VI:

$$C_{12}H_{25}O-(CH_2CH_2O)_{10}-H$$

Compound-VIII:

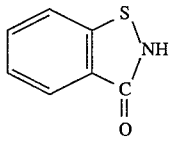

Preparation of Photographic Material Samples:

The above-mentioned coating liquid for emulsion layer and the above-mentioned coating liquid for surface-protecting layer were coated on the both surfaces of the above-mentioned support by co-extrusion coating. The amount of silver coated on one surface was 1.75 g/m$^2$.

Evaluation of Photographic Properties of Photographic Material Samples:

Each photographic material sample was exposed on its both surfaces for 0.05 seconds, using X-ray Ortho-screen HR-4 (produced by Fuji Photo Film Co.). After the exposure, the samples were processed with the automatic developing machine mentioned below, using the processing solutions mentioned below. The sensitivity of each sample was obtained as the logarithmic number of the reciprocal of the amount of exposure needed to give a density of (fog +0.1). A relative value of the sensitivity was obtained on the basis of the sensitivity (100) of the sample having emulsion (C). This is shown in Table 2 below.

Processing of Photographic Material Samples:

Automatic developing machine used:

CEPROS-M (produced by Fuji Photo Film Co.) was modified and used. Concretely, a heat roller was built in the drying zone of the machine and the running speed was accelerated. The dry-to-dry time was 30 seconds.

Preparation of Concentrated Processing Solutions:

| Developer: | |
|---|---|
| Part (A): | |
| Potassium hydroxide | 330 g |
| Potassium Sulfite | 630 g |
| Sodium Sulfite | 255 g |
| Potassium Carbonate | 90 g |
| Boric Acid | 45 g |
| Diethylene glycol | 180 g |
| Diethylenetriamine-pentaacetic acid | 30 g |
| 1-(N,N-diethylamino)ethyl-5-mercaptotetrazole | 0.75 g |
| Hydroquinone | 450 g |
| 4-Hydroxy-4-methyl-1-phenyl-3-pyrazolidone | 60 g |
| Water to make | 4125 ml |
| Part (B): | |
| Diethylene glycol | 525 g |
| 3,3'-Dithiobishydrocinnamic acid | 3 g |
| Glacial acetic acid | 102.6 g |
| 2-Nitroindazole | 3.75 g |
| 1-Phenyl-3-pyrazolidone | 34.5 g |
| Water to make | 750 ml |
| Part (C): | |
| Glutaraldehyde (50 wt/wt %) | 150 g |
| Potassium bromide | 15 g |
| Potassium metabisulfite | 105 g |
| Water to make | 750 ml |
| Fixer: | |
| Ammonium Thiosulfate (70 wt/vol %) | 3000 ml |
| Disodium ethylenediaminetetraacetate dihydrate | 0.45 g |
| Sodium sulfite | 225 g |
| Boric acid | 60 g |
| 1-(N,N-diethylamino)ethyl-5-mercaptotetrazole | 15 g |
| Tartaric acid | 48 g |
| Glacial acetic acid | 675 g |
| Sodium hydroxide | 225 g |
| Sulfuric acid (36N) | 58.5 g |
| Aluminium sulfate | 150 g |
| Water to make | 6000 ml |
| pH | 4.68 |

Preparation of Processing Solutions:

The above-mentioned parts (A), (B) and (C) of the concentrated developer were put into separate containers, which communicated with each other.

The above-mentioned fixer was put into a container of the same kind.

First, 300 ml of an aqueous solution containing 54 g of acetic acid and 55.5 g of potassium bromide were added to the developer tank as a starter.

The above-mentioned containers each filled with the processing solution were turned upside down and mounted on the corresponding stock tanks provided at the side of the automatic developing machine. Each stock tank had a sharp edge on itself. The sharp edge of each stock tank pierced through the seal film of the cap of each container, and the processing solution was introduced into each stock tank.

In this way, the processing solutions were introduced into the developer tank and the fixer tank of the automatic developing machine at the ratios mentioned below, by driving the pumps built in the machine.

Every time after 8 quarters of the photographic material sample were processed, the concentrated processing solutions were diluted with water at said ratios and introduced into the processing tanks of the machine.

| Developer: | |
|---|---|
| Part (A) | 51 ml |
| Part (B) | 10 ml |
| Part (C) | 10 ml |
| Water | 125 ml |
| pH | 10.50 |
| Fixer: | |
| Concentrated Fixer | 80 ml |
| Water | 120 ml |
| pH | 4.62 |

The rinsing tank was filled with city water.

0.4 g of pearlite grains (mean grain size: 100 μm, mean pore diameter: 3 μm) carrying anti-furring ray fungi thereon were put into each of three polyethylene bottles. The mouth of each bottle was covered with a 300-mesh nylon cloth, through which water and ray fungi could pass. Two of these three bottles were put on the bottom of the rinsing tank and the remaining one was put on the bottom of the stock tank for rinsing water. The stock tank contained 0.2 liters of rinsing water.

| Processing Speed and Processing Temperatures: | | |
|---|---|---|
| Development | 35° C. | 8.8 sec |
| Fixation | 32° C. | 7.7 sec |
| Rinsing | 17° C. | 3.8 sec |
| Squeegeeing | | 4.4 sec |
| Drying | 58° C. | 5.3 sec |
| Total | | 30 sec |

| Amounts of Replenishers: | |
|---|---|
| Developer: | 25 ml/10 × 12 inches |
| Fixer: | 25 ml/10 × 12 inches |

Evaluation of Pressure Resistance of Photographic Material Samples:

The photographic material samples prepared above were conditioned at 25° C. and 25% RH for one hour and then bent at an angle of 180 degrees around a stainless steel pipe having a diameter of 6 mm under the same condition. The bending speed was 180 degrees/sec, and the thus-bent samples were restored to the original condition within the next one second. 30 minutes after the bending test, the samples were processed in the same manner as above.

The increase in the density at the area that had been streakily blackened along the stainless steel pipe (excluding the intrinsic fog of the sample itself and the base density) was evaluated with the naked eye on the basis of the following criteria.

⊙: The blackened density was low, and the area was not desensitized.

○: The blackened density was relatively low, and the area was not desensitized.

Δ: The area was blackened and desensitized, but the practical use of the sample is acceptable.

x: The area was noticeably blackened and desensitized.

On the other hand, the photographic material samples prepared above were dipped in a fixer having the composition mentioned below, and the time needed before the emulsion was fixed to be transparent was measured with a spectrophotometer (Type U-3210, produced by Hitachi Ltd.). From this, the fixability of each sample was evaluated.

| Fixer: | |
|---|---|
| Sodium thiosulfate | 185 g |
| Disodium ethylenediamine-tetraacetate dihydrate | 0.025 g |
| Sodium metabisulfite | 22 g |
| Water to make | 1 liter |
| Sodium hydroxide to make | pH of 5.5 |

In this test, it is desirable that the fixing time is within 5.5 seconds.

On the other hand, the photographic material samples prepared above were processed with the automatic developing machine mentioned below, using the processing solutions mentioned below.

Automatic developing machine used:

Fuji Ray Processor CEPROS-M (produced by Fuji Photo Film Co.) was modified and used. Concretely, the driving shaft of the machine was so modified that the total processing time might be 30 seconds. The temperature at the blow-off outlet of the drying hot air was set at 55° C.

| Formulation of Developer: | |
|---|---|
| Part (A): | |
| Potassium hydroxide | 18.0 g |
| Potassium sulfite | 30.0 g |
| Sodium carbonate | 30.0 g |
| Diethylene glycol | 10.0 g |
| Diethylenetriamine-pentaacetic acid | 2.0 g |
| 1-(N,N-diethylamino)ethyl-5-mercaptotetrazole | 0.1 g |
| L-ascorbic acid | 43.2 g |
| 4-Hydroxymethyl-4-methyl-1-phenyl-3-pyrazolidone | 2.0 g |
| Water to make | 300 ml |
| Part (B): | |
| Triethylene glycol | 45.0 g |
| 3.3'-Dithiobishydrocinnamic acid | 0.2 g |
| Glacial acetic acid | 5.0 g |
| 5-Nitroindazole | 0.3 g |
| 1-Phenyl-3-pyrazolidone | 3.5 g |
| Water to make | 60 ml |
| Part (C): | |
| Glutaraldehyde (50%) | 10.0 g |
| Potassium Bromide | 4.0 g |
| Potassium metabisulfite | 10.0 g |
| Water to make | 50 ml |

Water was added to 300 ml of part (A), to 60 ml of part (B) and to 50 ml of part (C), separately, thereby making these one liter each. These were adjusted to have pH of 10.90.

4.50 liters of part (A), 0.90 liters of part (B) and 0.75 liters of part (C) were put into a bottle, CE-DFI (produced by Fuji Photo Film Co.), from which 1.5 liters of the solution was used.

Starter for Development:

Acetic acid was added to the above-mentioned replenisher for developer, by which the replenisher was adjusted to have pH of 10.20. This was used as the starter for development.

As the fixer, used was CE-Fl (produced by Fuji Photo Film Co.).

Temperature for Development: 35° C.

Temperature for Fixation: 35° C.

Temperature for Drying: 55° C.

The amount of the replenisher was 25 ml/10×21 inches (325 mg/m$^2$) for both the developer and the fixer. 600 sheets (each having a size of 10×12 inches) of each sample were processed continuously, and all the processed sheets had good properties.

In this test where a large number of the photographic material samples of the present invention were continuously developed with the automatic developing machine using the above-mentioned developer, there was found no change in the sensitivity of all the photographic material samples processed throughout the process.

On the other hand, the photographic material samples prepared above were imaged by X-ray exposure using the fluorescent screen described in JP-A-6-11804, and these gave good X-ray images.

The morphological characteristic values of the grains in the emulsions (A) to (G) of the present invention and the comparative emulsion (H) mentioned above are shown in Table 1 below.

TABLE 1

| Emulsion | Aspect Ratio of Core Grains | Aspect Ratio of Shell-coated Grains | |
|---|---|---|---|
| A | 7.2 | 7.9 | Emulsion of the Invention |
| B | 7.2 | 9.5 | Emulsion of the Invention |
| C | 7.2 | 6.5 | Emulsion of the Invention |
| D | 7.2 | 7.8 | Emulsion of the Invention |
| E | 7.2 | 9.5 | Emulsion of the Invention |
| F | 7.2 | 5.4 | Emulsion of the Invention |
| G | 7.2 | 4.8 | Emulsion of the Invention |
| H | 7.2 | 9.5 | Comparative Emulsion |

As shown in Table 1 above, it is known that the shell-coated grains of the emulsions of the present invention were anisotropically grown under the low-supersaturated condition at pCl of not lower than 1.65 or by adding fine grains thereto according to the present invention.

The sensitivity of the photographic material samples each containing any of the emulsions (A) to (G) of the present invention or the comparative emulsion (H) is shown in Table 2 below, where the sensitivity of the photographic material sample containing the comparative emulsion (H) is referred to as 100.

TABLE 2

| Photographic Material Sample | Emulsion | Sensitivity | Fog | |
|---|---|---|---|---|
| 1 | A | 195 | 0.05 | Emulsion of the Invention |
| 2 | B | 210 | 0.04 | Emulsion of the Invention |
| 3 | C | 140 | 0.05 | Emulsion of the Invention |
| 4 | D | 185 | 0.05 | Emulsion of the Invention |
| 5 | E | 195 | 0.04 | Emulsion of the Invention |
| 6 | F | 135 | 0.05 | Emulsion of the Invention |

TABLE 2-continued

| Photographic Material Sample | Emulsion | Sensitivity | Fog | |
|---|---|---|---|---|
| 7 | G | 150 | 0.04 | Emulsion of the Invention |
| 8 | H | 100 | 0.09 | Comparative Emulsion |

From Table 2 above, it is known that the photographic material samples of the present invention have a high sensitivity and a low fog when processed rapidly.

The results of the pressure test of the photographic material samples each containing any of the emulsions (A) to (G) of the present invention or the comparative emulsion (H) are shown in Table 3 below.

TABLE 3

| Photographic Material Sample | Blackening under Pressure | |
|---|---|---|
| 1 | ⊙ | Emulsion of the Invention |
| 2 | ⊙ | Emulsion of the Invention |
| 3 | Δ | Emulsion of the Invention |
| 4 | ○ | Emulsion of the Invention |
| 5 | ○ | Emulsion of the Invention |
| 6 | Δ | Emulsion of the Invention |
| 7 | Δ | Emulsion of the Invention |
| 8 | ○ | Comparative Emulsion |

From Table 3 above, it is known that the photographic material samples of the present invention have excellent pressure resistance comparable to that of photographic materials comprising emulsions of pure silver chloride grains.

The results of the fixation test of the photographic material samples each containing any of the emulsions (A) to (G) of the present invention or the comparative emulsion (H) are shown in Table 4 below.

TABLE 4

| Photographic Material Sample | Fixing Speed (sec) | |
|---|---|---|
| 1 | 4.2 | Emulsion of the Invention |
| 2 | 4.2 | Emulsion of the Invention |
| 3 | 4.2 | Emulsion of the Invention |
| 4 | 4.1 | Emulsion of the Invention |
| 5 | 4.1 | Emulsion of the Invention |
| 6 | 4.1 | Emulsion of the Invention |
| 7 | 4.2 | Emulsion of the Invention |
| 8 | 3.9 | Comparative Emulsion |

From Table 4 above, it is known that the photographic material samples of the present invention have excellent fixability comparable to that of photographic materials comprising emulsions of pure silver chloride grains.

EXAMPLE 2

Emulsions (A) to (H) were chemically sensitized in the same manner as in Example 1, except that tellurium compound-I was used in place of selenium compound-I. Using these, photographic material samples were produced and evaluated in the same manner as in Example 1.

The photographic material samples each containing any of the tellurium-sensitized emulsions (A) to (G) of the present invention also had a high sensitivity and a low fog when processed rapidly. In addition, these samples had excellent pressure resistance comparable to that of photographic materials comprising emulsions of pure silver chloride grains.

In the fixation test, these samples also had excellent fixability comparable to that of photographic materials comprising emulsions of pure silver chloride grains.

On the other hand, emulsions (A) to (H) were sensitized by ordinary gold sensitization and/or sulfur sensitization, using neither the selenium compound nor the tellurium compound. There was found no significant difference in sensitivity and fog between the photographic material samples each containing any of the gold and/or sulfur-sensitized emulsions (A) to (I) and the photographic material sample containing the comparative emulsion (H).

While the invention has been described in detail and with reference to specific embodiments thereof, it will be apparent to one skilled in the art that various changes and modifications can be made therein without departing from the spirit and scope thereof.

What is claimed is:

1. A silver halide emulsion which comprises multi-layered silver halide grains having a total $Cl^-$ content of 30 mol % to 90 mol % based on silver in the grains, having {100} faces as major faces and having an aspect ratio of 2 or more, wherein the multi-layered silver halide grains occupy not less than 30% of the total projected area of the total silver halide grains in the emulsion, wherein the multi-layered silver halide grains have been sensitized with a selenium sensitizer, a tellurium sensitizer, or a selenium sensitizer and a tellurium sensitizer; and wherein the multi-layered silver halide grains have been produced by growth of a shell around a core grain, said growth being conducted by adding fine silver halide grains to the core grains.

2. The silver halide emulsion as claimed in claim 1, wherein the multi-layered silver halide grains comprise a shell-coated core grain, and the aspect ratio of the shell-coated grain is larger than that of the core grain.

3. The silver halide emulsion as claimed in claim 1, wherein the outermost layer of the multi-layered silver halide grains has a $Br^-$ content of 20 mol % or more based on silver in the grains.

4. The silver halide emulsion as claimed in claim 1, wherein the outermost layer of the multi-layered silver halide grains has a $Br^-$ content of 50 mol % or more based on silver in the grains.

5. The silver halide emulsion as claimed in claim 1, wherein the multi-layered silver halide grains are two-layered core-shell grains.

6. The silver halide emulsion as claimed in claim 1, wherein the multi-layered silver halide grains have been produced by growth of the shell around a core, said growth being conducted at a $pCl^-$ of 1.60 or more.

7. The silver halide emulsion as claimed in claim 1, wherein the multi-layered silver halide grains have a $Br^-$ content of 5 mol % to 70 mol % based on silver in the grains.

8. The silver halide emulsion as claimed in claim 1, wherein the multi-layered silver halide grains have a total $Br^-$ content of 1 to 80 mol % based on silver in the grains.

9. The silver halide emulsion as claimed in claim 1, wherein the multi-layered silver halide grains have a thickness of 0.03 to 0.3 μm.

10. The silver halide emulsion as claimed in claim 1, wherein the multi-layered silver halide grains have a diameter of the circle corresponding to the projected area of 0.2 to 5 μm.

11. The silver halide emulsion as claimed in claim 1, wherein the multi-layered silver halide grains have a monodisperse size distribution.

12. The silver halide emulsion as claimed in claim 1, wherein the multi-layered silver halide grains have a coefficient of variation of the grain size distribution of 0 to 0.4.

13. The silver halide emulsion as claimed in claim 1, wherein the ratio of the aspect ratio of the core grain to the aspect ratio of the shell-coated grain is 0.95 or less.

14. The silver halide emulsion as claimed in claim 1, wherein the sensitizer is used in an amount of from $10^{-8}$ to $10^{-2}$ mol per mol of the silver halide in the silver halide emulsion.

15. A silver halide photographic material comprising a silver halide emulsion including multi-layered silver halide grains having a total $Cl^-$ content of 30 mol % to 90 mol % based on silver in the grains, having {100} faces as major faces and having an aspect ratio of 2 or more, wherein the multi-layered silver halide grains occupy not less than 30% of the total projected area of the total silver halide grains in the emulsion, wherein the multi-layered silver halide grains have been sensitized with a selenium sensitizer, a tellurium sensitizer, or a selenium sensitizer and a tellurium sensitizer; and wherein the multi-layered silver halide grains have been produced by growth of a shell around a core grain, said growth being conducted by adding fine silver halide grains to the core grains.

* * * * *